US008727465B2

(12) United States Patent
Tokuno

(10) Patent No.: US 8,727,465 B2
(45) Date of Patent: May 20, 2014

(54) LIQUID SUPPLY METHOD IN LIQUID-JET APPARATUS

(75) Inventor: Toshiroh Tokuno, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 400 days.

(21) Appl. No.: 13/042,642

(22) Filed: Mar. 8, 2011

(65) Prior Publication Data

US 2011/0226340 A1 Sep. 22, 2011

(30) Foreign Application Priority Data

Mar. 16, 2010 (JP) ..... 2010-059765

(51) Int. Cl.
*B41J 29/38* (2006.01)
*B41J 2/175* (2006.01)

(52) U.S. Cl.
CPC ..... *B41J 2/17556* (2013.01); *B41J 2/17509* (2013.01)
USPC ..... 347/6

(58) Field of Classification Search
CPC ..... B41J 2/17556; B41J 2/17509
USPC ..... 347/6
See application file for complete search history.

(56) References Cited

U.S. PATENT DOCUMENTS 7,540,598 B2 6/2009 Hori et al.
7,871,158 B2 1/2011 Kaneko
2004/0085416 A1* 5/2004 Kent ..... 347/89
2007/0109362 A1* 5/2007 Hori et al. ..... 347/65
2009/0167795 A1* 7/2009 Yokouchi ..... 347/6

FOREIGN PATENT DOCUMENTS

JP 2005-59274 3/2005
JP 2005-59490 3/2005
JP 2008-143073 6/2008
JP 2009-23092 2/2009

OTHER PUBLICATIONS

Japanese official action dated Nov. 8, 2013 in corresponding Japanese patent application No. 2010-059765.

* cited by examiner

*Primary Examiner* — Manish S Shah
*Assistant Examiner* — Jeffrey C Morgan
(74) *Attorney, Agent, or Firm* — Cooper & Dunham, LLP

(57) ABSTRACT

A method for supplying a liquid from a liquid tank to a head tank fixed to a liquid-jet head utilizing a liquid supply device in a liquid-jet apparatus is disclosed. The method includes jetting the liquid droplets from the liquid-jet head while maintaining a meniscus pressure of the liquid-jet head within a predetermined range; detecting the meniscus pressure of the liquid-jet head; carrying out, when the detected meniscus pressure is lower than the predetermined range, a first liquid supply operation such that the detected meniscus pressure of the liquid-jet head being lower than the predetermined range is restored to the predetermined range; and carrying out, while the first liquid supply operation is not being carried out, a second liquid supply operation such that the liquid is supplied to the head tank in an amount less than a liquid-jetted amount computed based on a liquid-jet signal.

13 Claims, 11 Drawing Sheets

LIQUID SUPPLY METHOD IN LIQUID-JET APPARATUS

BACKGROUND OF THE INVENTION

1. Field of the Invention

The invention relates to a liquid supply method in a liquid-jet apparatus.

2. Description of the Related Art

A serial inkjet recording apparatus typically includes a carriage that scans in a main scanning direction perpendicular to a sheet transfer direction, and the carriage includes a liquid-jet head having plural nozzles to jet liquid toward a sheet. One of methods for supplying ink to the liquid-jet head includes supplying ink from an ink cartridge to the liquid-jet head. The other method may include temporarily supplying ink from the ink cartridge fixed to a predetermined position to a head tank arranged above the liquid-jet head via a liquid supply tube, and transferring the ink temporarily supplied in the head tank to the liquid-jet head communicating with the head tank.

In the liquid-jet head, ink pressure in the nozzles may preferably be adjusted in a range of −0.2 to −1 kPa for jetting appropriate ink droplets. As already described, the liquid-jet head is communicating with the head tank. Accordingly, meniscus pressure, which is pressure near nozzle interfaces of the nozzles in the liquid-jet head, may be controlled by adjusting an internal pressure of the head tank. Japanese Patent Application Publication No. 2005-59490 (hereinafter referred to as "Patent Document 1") discloses an example of a head tank configuration that is capable of adjusting the internal pressure of the head tank. The head tank disclosed in Patent Document 1 includes a flexible member. The head tank disclosed also includes an elastic member that extends slightly longer than its natural length when introducing ambient air into the head tank and applies a bias to the flexible member in a direction from inside to outside of the flexible member when the head tank is at a negative pressure.

An ink supply method for the head tank disclosed in Patent Document 1 is described in detail below. As described above, since the head tank disclosed in Patent Document 1 is formed of the flexible member, the flexible member gradually expands and deforms as ink is supplied to the head tank to increase an ink volume inside the ink tank. That is, when the head tank is filled with the ink (i.e., when the head tank is full), the head tank formed of the flexible member is fully expanded by introducing ambient air, and ink is supplied to the fully expanded head tank. After the head tank is filled with ink, the head tank is enclosed or shielded. Thereafter, when the nozzles of the liquid-jet head communicating with the head tank jet several ink droplets, the entire ink volume is reduced in an amount corresponding to the amount of the ink droplets jetted from the nozzles of the liquid-jet head. With the reduction of the entire ink volume, the head tank formed of the flexible member may spontaneously shrink. However, the elastic member prevents the flexible member from shrinking by the application of the bias to the flexible member as described above. Accordingly, the liquid-jet head and the head tank communicating with the liquid-jet head include an initial negative pressure.

The ink volume inside the head tank is reduced while ink is consumed by jetting ink droplets from the liquid-jet head, and the head tank formed of the flexible member deforms in a direction from the outside to the inside of the head tank. In this process, since the elastic member applies the bias to the flexible member in a direction from the inside to the outside of the head tank formed of the flexible member, the negative pressure inside the head tank and the liquid-jet head obtained by jetting ink droplets after cancellation of the ambient air introduction may be adjusted in a range in which the liquid-jet head is capable of jetting ink droplets.

Further, in the head tank configuration disclosed in Patent Document 1, a lever is attached to the head tank formed of the flexible member such that a remaining amount of ink in the head tank is detected by detecting a position of a pointed end of the lever. The lever is attached to the head tank formed of the flexible member capable of generating a negative pressure inside the head tank, and hence the lever is hereinafter called a negative pressure lever. The position of the negative pressure lever is detected either by its home position or by a negative lever position detecting sensor provided near a maintenance-restoration section that restores a nozzle jet function by suctioning remaining ink (liquid) inside the nozzles of the liquid-jet head or cleaning a periphery of the nozzle face of the liquid-jet head. In the head tank configuration disclosed in Patent Document 1, the position of the negative pressure lever when the initial negative pressure is generated inside the head tank and the position of the negative pressure lever when the head tank is filled with ink are detected, and information on such detected positions of the negative pressure lever is stored in advance. In the head tank configuration disclosed in Patent Document 1, when printing is continuously carried out, an amount of ink to be jetted based on liquid-jet signals may be estimated in advance. If an estimated value corresponding to the cumulative amount of ink jetted reaches a threshold indicating that ink needs to be supplied to the head tank, the printing is temporarily interrupted and ink is supplied to the head tank without introducing an ambient air until the position of the negative pressure lever returns to the stored position detected by the negative pressure lever detecting sensor when the initial negative pressure is generated inside the head tank.

However, in the head tank configuration disclosed in Patent Document 1, the amount of ink to be jetted based on the liquid-jet a signal is estimated in advance. If the estimated value corresponding to the cumulative amount of ink to be jetted reaches a threshold indicating that ink needs to be supplied to the head tank, the printing is temporarily interrupted. Then, the carriage is returned to the home position or to a position of the maintenance-restoration section where the negative pressure lever detecting sensor is provided for detecting the position of the negative pressure lever. Thereafter, ink is supplied to the head tank until the position of the negative pressure lever returns to the initial position of the negative pressure lever detected by the negative pressure lever detecting sensor when the initial negative pressure is generated inside the head tank. As described above, with the head tank configuration disclosed in Patent Document 1, the printing may not be restarted until the negative pressure lever detecting sensor detects via the negative pressure lever that the head tank is filled with the ink. Thus, printing duration in total may become longer because the printing duration includes traveling time for the carriage traveling for detecting the negative lever position, detecting time for the amount of ink supplied, and ink supply time for supplying ink to the head tank until the head tank is filled with ink.

SUMMARY OF THE INVENTION

It is a general object of at least one embodiment to provide a method for supplying ink in an inkjet apparatus capable of reducing the number of ink supply operations by detecting a negative pressure lever so as to reduce printing time that substantially obviates one or more problems caused by the limitations and disadvantages of the related art.

In one embodiment, there is provided a method for supplying a liquid from a liquid tank to a head tank fixed to a liquid-jet head utilizing a liquid supply device in a liquid-jet apparatus. The method includes jetting the liquid droplets from the liquid-jet head while maintaining a meniscus pressure of the liquid-jet head within a predetermined range; detecting the meniscus pressure of the liquid-jet head; carrying out, when the detected meniscus pressure is lower than the predetermined range, a first liquid supply operation such that the detected meniscus pressure of the liquid-jet head being lower than the predetermined range is restored to the predetermined range; and carrying out, while the first liquid supply operation is not being carried out, a second liquid supply operation such that the liquid is supplied to the head tank in an amount less than a liquid-jetted amount computed based on a liquid-jet signal.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

In the following, embodiments of the present invention will be described with reference to the accompanying drawings.

First, a mechanical section of an inkjet recording apparatus according to an embodiment is described with reference to FIGS. 1 and 2. Note that FIG. 1 is a schematic configuration diagram illustrating an entire mechanical configuration of the inkjet recording apparatus and FIG. 2 is a plan diagram illustrating the mechanical section of the inkjet recording apparatus according to the embodiment.

Figure 1:
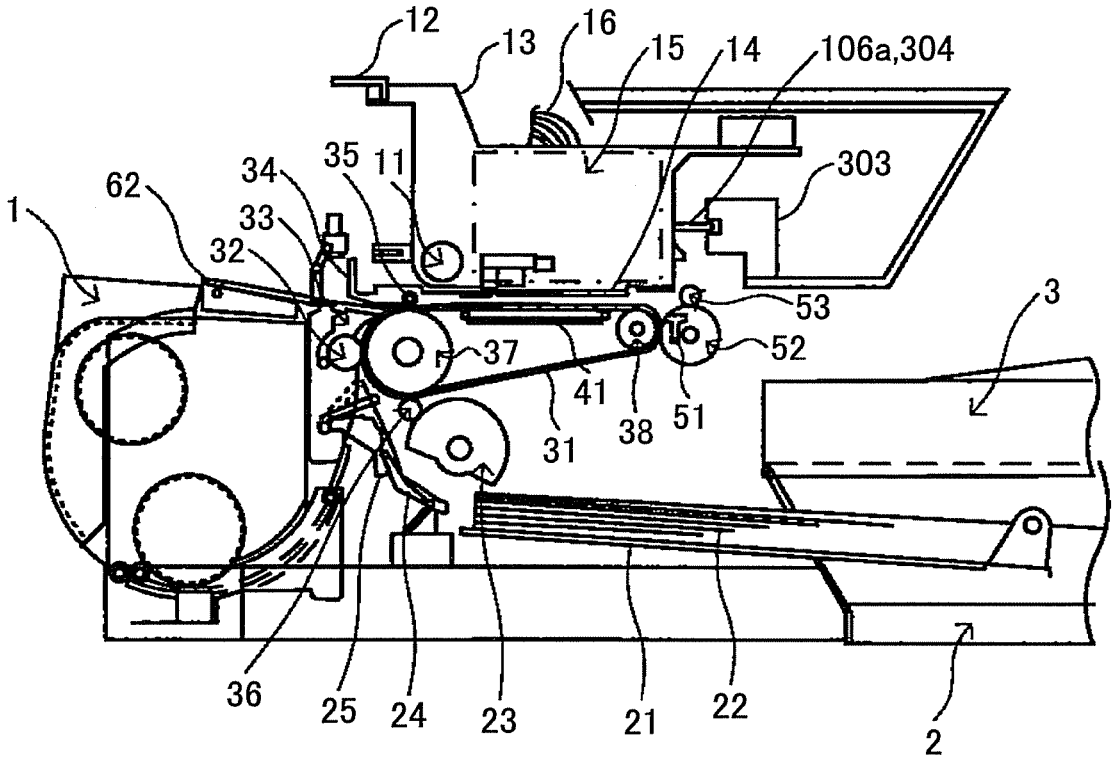
FIG. 1 is a schematic configuration diagram illustrating an entire mechanical configuration of an inkjet recording apparatus according to an embodiment.
Figure 2:
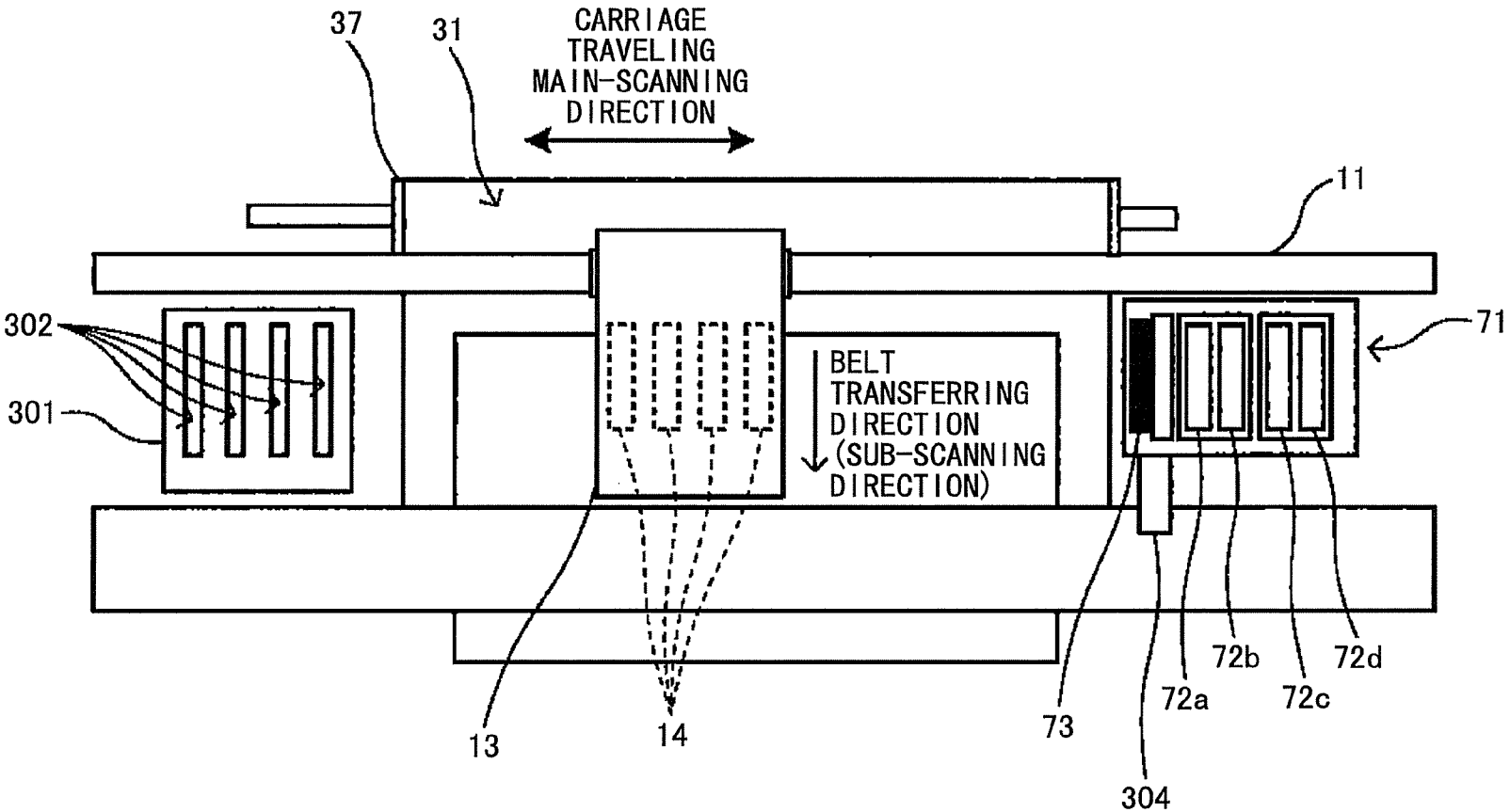
FIG. 2 is a plan diagram illustrating a major part of a mechanical section of the inkjet recording apparatus according to the embodiment.

In FIGS. 1 and 2, a carriage 13 is slideably supported by a guide rod 11 and a stay 12 laterally arranged on not-shown side plates in a main-scanning direction such that the carriage 13 is moved by a not-shown main scanning motor in the main-scanning direction indicated by a left-right arrow in FIG. 2 while scanning. The carriage 13 includes a recording head 14 composed of four inkjet heads to jet ink droplets of colors of yellow (Y), cyan (C), magenta (M), and black (B). The four inkjet heads of the recording head 14 include inkjet ports that are arranged in a direction perpendicular to the main-scanning direction (i.e., a sub-scanning direction in FIG. 2) with the inkjet ports facing downward.

Preferable examples of the four inkjet heads forming the recording head 14 include a piezoelectric actuator such as a piezoelectric element, a thermal actuator utilizing a phase change caused by liquid film boiling by an electrothermal element such as a heat element, a shape memory alloy actuator utilizing a metallic phase due to temperature variation, and a static actuator utilizing electrostatic force, which are utilized as an energy generating device. In this embodiment, the inkjet head that includes the piezoelectric actuator (i.e., the piezoelectric element) as the energy generating device is utilized. Alternatively, the recording head 14 may be formed of one inkjet head that includes plural nozzle arrays to jet ink droplets of respective colors.

The carriage 13 includes head tanks 15 that are liquid containers to supply respective colors to the recording head 14. The head tanks 15 are supplied with ink from not-shown ink cartridges that are main tanks of the respective colors via ink supply tubes 16. Note that the ink cartridges contain ink of respective colors yellow (Y), cyan (C), magenta (M), and black (B); however, the not-shown ink cartridge containing the black ink has a ink content capacity larger than ink content capacities of the ink cartridges containing ink other than the black ink.

The inkjet recording apparatus further includes a semicircular feeding round bar 23 and a separation pad 24 made of a material having a high friction coefficient and directed to face the feeding round bar 23. The feeding round bar 23 and the separation pad 24 are used as a sheet-feeding section for feeding sheets 22 accumulated on a sheet accumulating section (platen) 21 of a sheet-feed tray 2. The sheet-feeding section composed of the feeding round bar 23 and the separation pad 24 is configured to feed sheets 22 one-by-one from the sheet accumulating section 21, and the separation pad 24 is biased toward the feeding round bar 23 side.

The inkjet recording apparatus further includes a transfer section to transfer the sheet 22 transferred from the sheet-feeding section beneath the recording head 14. The transfer section includes a transfer belt 31 to transfer the sheet 22 while electrostatically attracting the sheet 22, a counter roller 32 to transfer the sheet 22 transferred from the sheet-feeding section via a guide 25 while sandwiching the sheet 22 between the counter roller 32 itself and the transfer belt 31, a transfer guide 33 to turn the sheet 22 upwardly transferred in an approximately vertical direction at 90 degrees to be carried on the transfer belt 31, and a front end pressure round bar 35 biased toward the transfer belt 31 by a pressure member 34. The transfer section further includes a charging roller 36 as a charging device to charge a surface of the transfer belt 31.

The transfer belt 31 is an endless belt that is looped over a transfer roller 37 and a tension roller 38 so as to rotationally travel in a belt transferring direction (i.e., the sub-scanning direction in FIG. 2). The charging roller 36 is configured to be brought into contact with a surface layer of the transfer belt 31 and be rotationally driven by the rotation of the transfer belts 31. Both ends of a shaft of the charging roller 36 have applied a force of 2.5 N.

Further, a guide member 41 is arranged corresponding to a recording region in which recording is made by the recording head 14 at a rear side of the transfer belt 31. The guide member 41 is downwardly projected toward a side opposite to the recording head 14 side based on a tangent line of the two rollers, namely, the transfer roller 37 and the tension roller 38, upper surfaces of which support the transfer belt 31. Since the transfer belt 31 is upwardly pressed by an upper surface of the guide member 41 in the printing region, high flatness of the transfer belt 31 may be excellently maintained.

Further, plural grooves are formed in the upper surface of the guide member 41 in the main-scanning direction, that is, a direction perpendicular to the transferring direction. The upper surface of the guide member 41 having the plural grooves has a reduced contact area to be in contact with the rear surface of the transfer belt 31 such that the transfer belt 31 may move along the surface of the guide member 41 without interruption.

The inkjet recording apparatus further includes a sheet-discharging section. The sheet-discharging section includes a separation claw 51 for separating the sheet 22 from the transfer belt 31, a sheet-discharge roller 52, a sheet-discharge round bar 53, and a sheet-discharge tray 3 located at a lower side of the sheet-discharge roller 52. Note that a space (height) from a nip between the sheet-discharge roller 52 and the sheet-discharge round bar 53 to the sheet-discharge tray 3 is sufficiently provided such that a substantial number of sheets may be kept in the sheet-discharge tray 3.

The inkjet recording apparatus further includes a not-shown duplex printing sheet-feed device detachably attached at the back of an inkjet recording apparatus main body 1. The duplex printing sheet-feed device captures the sheet 22 rotationally transferred in a reverse direction of the transfer belt 31, reverses the sheet 22, and then feeds the reversed sheet 22 back to a nip between the counter roller 32 and the transfer belt 31. The inkjet recording apparatus further includes a manual bypass tray 62 on top of the duplex printing sheet-feed device.

As illustrated in FIG. 2, the inkjet recording apparatus further includes a maintenance-restoration mechanism (hereinafter called a "sub-system") 71 arranged in a first non-printing region at one side of the carriage 13 in the carriage main-scanning direction. The sub-system 71 is provided for maintaining and restoring nozzle states of the recording head 14. The sub-system 71 includes caps 72*a*, 72*b*, 72*c*, and 72*d* to cap the nozzle surfaces of the recording head 14 and a wiper blade 73 to wipe the nozzle surfaces. Note that in the sub-system 71, the cap 72*a* located closest to the recording region side is used as a suction and moisture-retention cap connected to a not-shown suction pump, and the remaining caps 72*b*, 72*c*, and 72*d* are used as simple moisture-retention caps.

The inkjet recording apparatus further includes a non-print jetting ink receiver mechanism 301 in a second non-printing region opposite to the first non-printing region at the other side of the carriage 13 in the carriage main-scanning direction. The non-print jetting ink receiver mechanism 301 includes respective slits 302 arranged for the nozzles of the recording head 14, and used as a receiver to receive the ink jetted as a result of non-print jetting operations to prevent ink inside unused nozzles from drying during a recording operation. Note that the ink inside the unused nozzles that has dried during the recording operation may result in inkjet failure.

In the inkjet recording apparatus having the above configuration, the sheet 22 is separated one sheet at a time from others in the sheet-feed tray 2 illustrated in FIG. 1, and the sheet 22 upwardly transferred in an approximately vertical direction is guided by the guide 25. The transferred sheet 22 is then further transferred by being sandwiched between the transfer belt 31 and the counter roller 32. A front end of the sheet 22 is guided by the transfer guide 33, and is then pressed on the transfer belt 31 by the front end pressure round bar 35. Thereafter, the transferring direction of the sheet 22 is changed by approximately 90 degrees.

In this process, voltages are alternately applied from a high voltage power source by a not-shown control circuit to the charging roller 36 to output plus and minus charges so that the transfer belt 31 is charged with alternate charge voltage patterns by the charging roller 36. That is, the transfer belt 31 is charged such that the transfer belt 31 includes alternately arranged plus and minus charged bands having predetermined widths in the sub-scanning direction (i.e., a traveling direction of the transfer belt 31). When the sheet 22 is fed onto the transfer belt 31 alternately charged with plus and minus charge voltages, the sheet 22 is electrostatically attracted to the transfer belt 31 so that the sheet 22 is transferred in the sub-scanning direction with rotational traveling of the transfer belt 31.

The recording head 14 is driven based on image signals while the carriage 13 is moved such that recording head 14 jets ink droplets onto the stationary sheet 22, thereby recording one line with the jetted ink droplets. The sheet 22 is then transferred by a predetermined amount, and the next line is subsequently recorded on the sheet 22 with next-jetted ink droplets. The recording operation is terminated when a signal indicates that a rear end of the sheet 22 has reached the recording region. The sheet 22 is then discharged onto the sheet-discharge tray 3.

Further, the carriage 13 is moved toward the sub-system 71 side while printing (recording) is in a stand-by mode, where the recording head 14 is capped with the caps 72*a* to 72*d* to maintain the nozzles in moisturizing conditions, thereby preventing inkjet failure due to drying of ink inside the nozzles. Or inkjet restoration operations may be carried out on the nozzles containing ink that is not used in the middle of recording or before starting to record. Thus, stable inkjet performance may be maintained. Note that the cap 72*a* is used as the suction cap. Thus, when the inkjet restoration operations are carried out, the recording head 14 is moved to a position corresponding to the cap 72*a* to cap the corresponding nozzle of the recording head 14.

Figure 3:
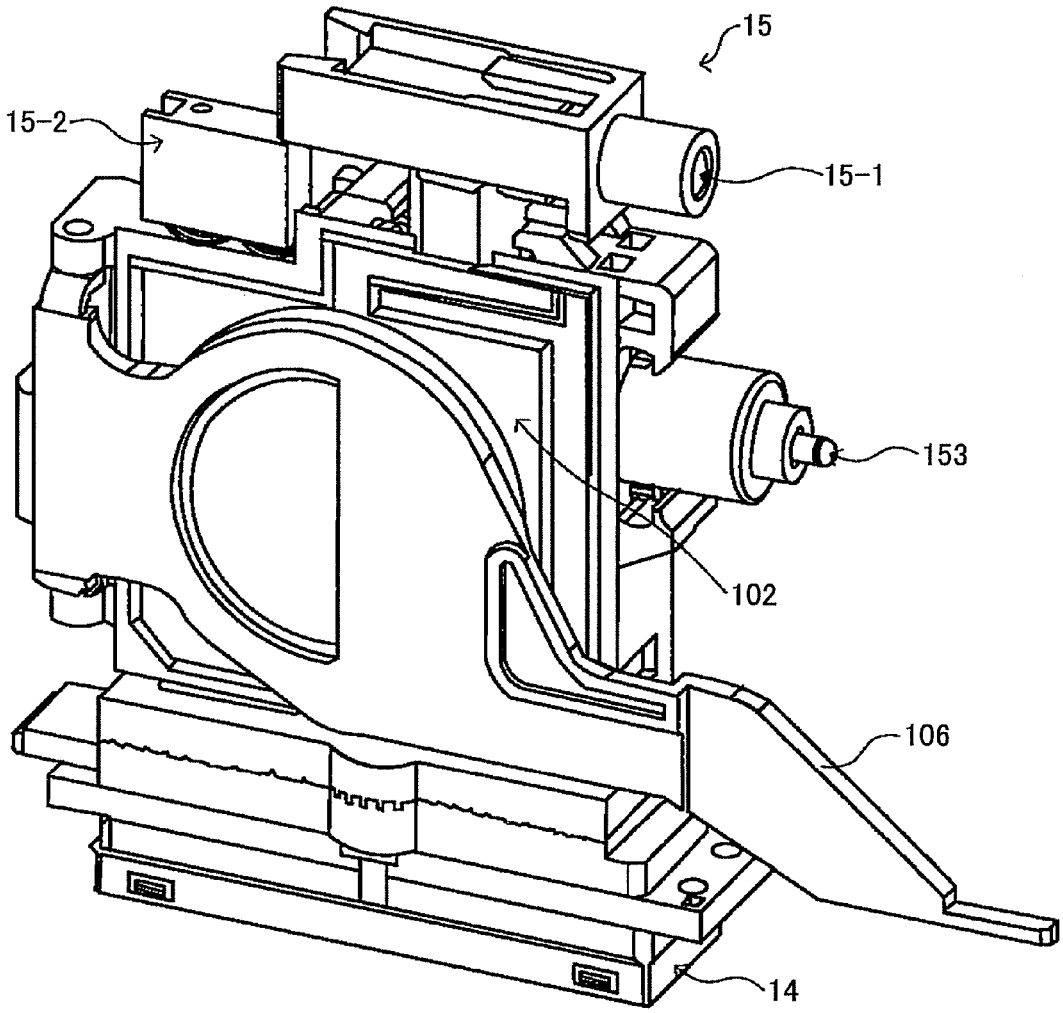
FIG. 3 is a perspective diagram illustrating a configuration of an ink supply device.

Further, a negative pressure lever position detecting sensor 303 is configured to detect a position of a detective end 106*a* of a negative pressure lever 106 (see FIG. 3). The negative pressure lever 106 is used as a negative pressure indicating device. Thus, the position of the detective end 106*a* of the negative pressure lever 106 indicates whether the head tank 15 has a negative pressure. Note that the negative pressure lever position detecting sensor 303 may be a photointerrupter, which may detect the presence of the negative pressure lever 106. The mechanism of the negative pressure lever position detecting sensor 303 to detect the position of the negative pressure lever 106 is as follows. The mechanism of the negative pressure lever position detecting sensor 303 is achieved by a combination of a system for detecting a position of the carriage 13, that is, the combination of an encoder and the phtointerrupter. Accordingly, the negative pressure lever position detecting sensor 303 is configured to detect the detective end 106*a* of the negative pressure lever 106 based on the information on the position of the carriage 13.

Figure 4:
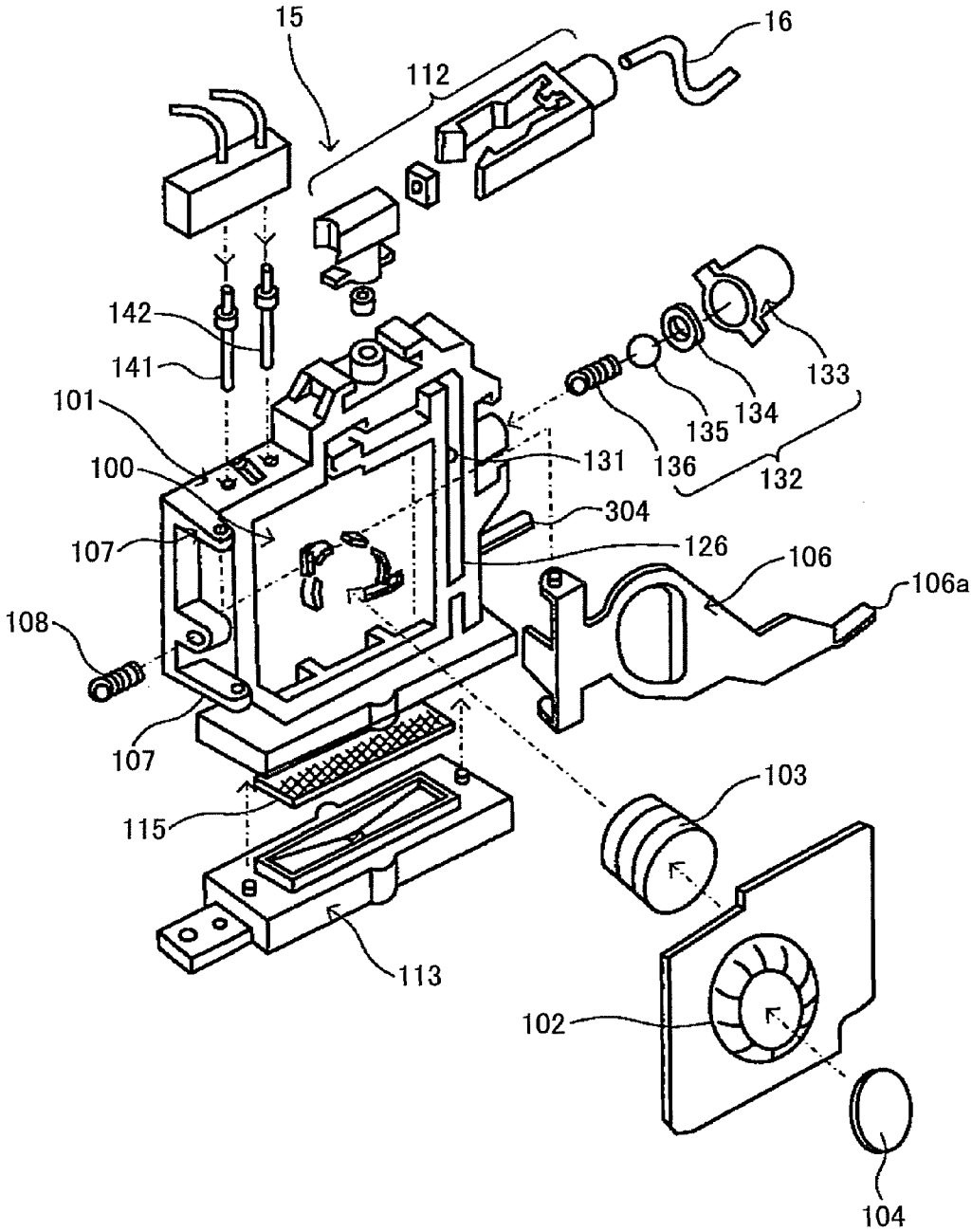
FIG. 4 is an exploded perspective diagram illustrating the ink supply device.

Next, details of an ink supply device provided as a liquid supply device in the inkjet recording apparatus is described with reference to FIG. 4. Note that FIG. 3 is a perspective diagram illustrating a configuration of the ink supply device. FIG. 4 is an exploded perspective diagram illustrating the ink supply device. As illustrated in FIG. 3, in the ink supply device the negative pressure lever 106 is provided inside the head tank 15. Inside the head tank 15, a negative pressure is generated by allowing a spring 103 (see FIG. 4) to apply bias to the film member 102. The negative pressure lever 106 is operated by following a positional change of a film member 102. The film member 102 is displaced based on a consumed amount of ink contained inside the head tank 15. A supply port 15-1 is configured to supply ink from an ink cartridge to the head tank 15 via the ink supply tube. An air introducing pin 153 is configured to optionally introduce ambient air into the head tank 15. Further, the recording head 14 is configured to jet ink droplets and arranged beneath the head tank 15. In addition, the head tank 15 further includes a detective mechanism 15-2 configured to detect ink or air.

As illustrated in FIG. 4, the ink supply device includes the head tank 15 attached to the carriage 13 and used as a liquid container configured to supply ink to the recording head 14 and a not-shown ink cartridge used as a main tank configured to supply ink to the head tank 15 via the ink supply tube 16. The head tank 15 includes a container (i.e., a case) 101 forming an ink container 100 configured to contain ink, a film member (a flexible film member) 102 adhered to or welded to the case 101 and configured to seal an opening (i.e., one surface of the head tank 15) of the ink container 100. The head tank 15 further includes the spring 103 as an elastic member configured to apply bias to the film member 102 in an outside direction. The spring 103 is arranged between the case 101 and the film member 102 inside the ink container 100 to form a negative pressure generator section configured to generate a negative pressure inside the ink container 100 by discharging or supplying ink (liquid).

The head tank 15 further includes the negative pressure lever 106 attached to an outer surface of the film member 102. The negative pressure lever 106 is movably attached to a support 107 provided on a side of the case 101. The negative pressure lever 106 may be moved (displaced) based on the deformation of the film member 102. The negative pressure lever 106 is biased toward a contact side where the negative pressure lever 106 is in contact with the film member 102 by a spring 108 provided between the case 101 and the negative pressure lever 106. With this configuration, the negative pressure lever 106 may detect the amount of ink based on the deformation of the film member 102. That is, since the negative pressure lever 106 moves based on the volume change of the head tank 15, the amount of ink is detected by causing the negative pressure lever position detecting sensor 303 to detect a position of the detective end 106*a* of the negative pressure lever 106.

Further, the case 101 includes a not-shown ink introducing path for supplying ink to the ink container 100, and a coupling device 112 is detachably attached to the case 101 for connecting the ink supply tube 16 connected to the not-shown ink cartridge with the ink introducing path arranged inside the case 101. Note that a later described liquid supply pump (i.e., ink supply pump) may be arranged between the ink cartridge and the head tank 15 to pump ink from the ink cartridge to the head tank 15. Further, a coupling member 113 is attached to a lower part of the case 101 for supplying ink from the ink container 100 to the recording head 14. The coupling member 113 forms a not-shown ink supply path for the recording head. Further, a filter 115 is provided between the coupling member 113 and the ink container 100.

Further, a not-shown air passage for discharging air from the ink container 100 is provided above the case 101. The air passage includes a not-shown entrance section and a not-shown passage section continued from the entrance section (an orthogonal passage section). The air passage further includes an accumulation section 126 configured to communicate with an air introducing hole 131 provided in the case 101. The accumulation section 126 is formed at a lower side of the air introducing hole 131.

An air introducing valve mechanism 132 is provided for the air introducing hole 131 such that the air introducing valve mechanism 132 is used as an air introducing device configured to switch the head tank 15 between a sealing state and an air introducing state. The air introducing valve mechanism 132 includes a holder 133, a valve seat ring 134 inside the holder 133, a ball 135 used as a valve element, and a spring 136 configured to apply bias to the ball 135 toward the valve seat ring 134 side. Note that the accumulation section 126 functions as an ink accumulation section when the inkjet recording apparatus is tilted or shaken, and ink is introduced in the air passage. Thus, the ink having penetrated from the air passage is accumulated in the accumulation section 126. With this configuration, the ink is prevented from penetrating via the air passage if the inkjet recording apparatus fall while being transported. Accordingly, the air introducing valve mechanism 132 may be prevented from experiencing a malfunction that might otherwise result from the ink solidifying inside the air introducing hole 131.

Further, two detective electrodes 141 and 142 are provided above the case 101. The two detective electrodes 141 and 142 are configured to detect the amount of air inside the head tank 15 when the amount of air inside the head tank 15 reaches a predetermined amount or more. The amount of air inside the head tank 15 may be detected based on the conductivity between the two detective electrodes 141 and 142. That is, if the two detective electrodes 141 and 142 are immersed in the ink, the two detective electrodes 141 and 142 are electrically conducting whereas if one of the detective electrodes 141 and 142 is immersed in the ink, the two detective electrodes 141 and 142 are not electrically conducting. The amount of air inside the head tank 15 is detected based on the difference in the conductivity between the two detective electrodes 141 and 142. Further, as illustrated in FIG. 4, an air introducing pin 153 (see FIG. 3) is movably provided in the air introducing valve mechanism 132 of the head tank 15 such that the air introducing pin 153 presses the ball 135 against the spring 136 to introduce the ambient air. The inkjet recording apparatus main body side includes a not shown driving device having an activation lever 161 to activate the air introducing pin 153.

Next, an ink supply operation to supply ink in the head tank 15 in the inkjet recording apparatus according to the embodiment is described below.

Figure 5:
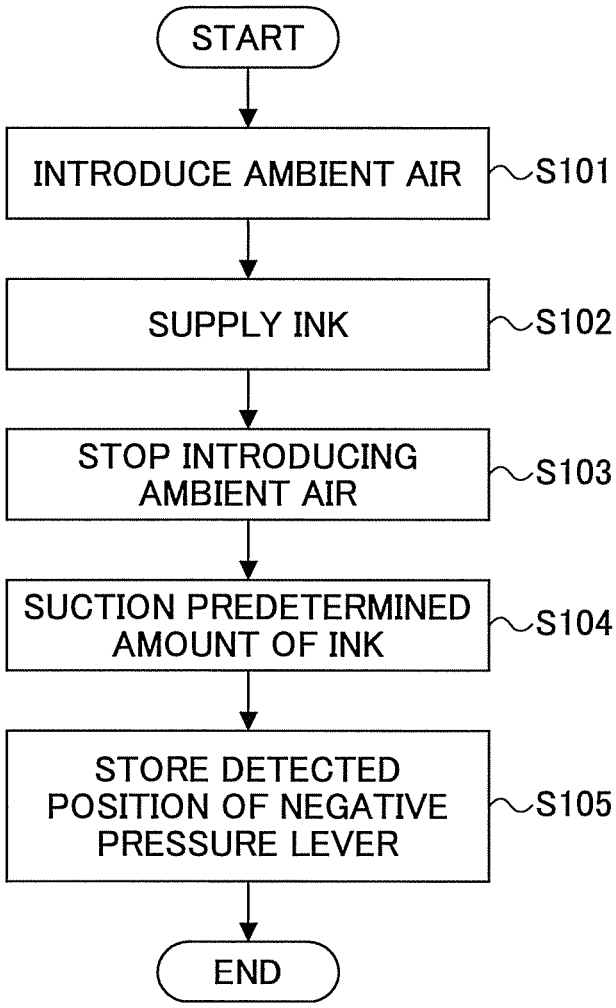
FIG. 5 is a flowchart illustrating an ink supply control operation by introducing ambient air.

In the ink supply device of the inkjet recording apparatus, the ink supply operations to supply ink from the main tank 10 to the head tank 15 includes two types of the ink supply operation; one is an air introducing ink supply operation in which ink is supplied from the main tank 10 to the head tank 15 by introducing ambient air and the other is an ordinary ink supply operation in which ink is supplied from the main tank 10 to the head tank 15 without the ambient air introduction. The air introducing ink supply operation is described with reference to an operation flowchart in FIG. 5. First, the not shown driving device activates the air introducing pin 153 to open the air introducing valve mechanism 132 so that ambient air is introduced into the head tank 15 via the air introducing valve mechanism 132 (step S101). When the ambient air is introduced into the head tank 15, the film member 102 is pressed toward an outer side by a restoring force of the spring 103, which increases the capacity of the head tank 15 (i.e., the negative pressure generator section is expanded). While the capacity of the head tank 15 is increased by the introduction of the ambient air, ink is supplied (sent) by a liquid supply mechanism from the ink cartridge (i.e., the main tank) 10 to the head tank 15 (step S102). While the head tank 15 is filled with ink, the head tank 15 is sealed by closing the air introducing valve mechanism 132 so that the ambient air is no longer introduced (step S103). The cap 72*a* in the sub-system illustrated in FIG. 2 is then placed on a corresponding nozzle surface of the recording head 14. Thereafter, a not-shown capping motor activates a not-shown suction pump to suction the nozzle surface of the recording head 14 that includes the head tank 15 to which ink has been supplied, so that a predetermined amount of ink is discharged from the nozzle surface of the recording head 14 (step S104). When the predetermined amount of ink is discharged, the film member 102 of the head tank 15 is inwardly deformed by the bias force of the spring 103, and the capacity of the head tank 15 is decreased (i.e., the negative pressure generator section is contracted), thereby generating an initial negative pressure in the head tank 15. Thereafter, the negative pressure lever position detecting sensor 303 detects a position of the detective end 106*a* of the negative pressure lever 106 and stores the detected position of the negative pressure lever 106 (step S105). Note that the air introducing ink supply operation may be achieved by the following alternative method. For example, while the ambient air is introduced in the head tank 15, the flexible film member 102 is inwardly pressed against the spring 103 by the negative pressure lever 106 to decrease the capacity of the head tank 15. Then, ink is supplied (sent) from the ink cartridge (main tank) 10 to the head tank 15 by the liquid supply mechanism. The head tank 15 is sealed by closing the air introducing valve mechanism 132 so that the ambient air is no longer introduced. The film member 102 of the head tank 15 is outwardly deformed by cancelling of the bias force of the spring 103, thereby generating a negative pressure in the head tank 15. With this configuration, since a negative pressure is generated inside the head tank 15 by a combination of the flexible film member and the elastic member, the configuration of the negative pressure generator mechanism may become simpler.

Next, the ordinary ink supply operation is described. In this operation, a consumed amount V of ink (i.e., the number of ink droplets is counted) is detected, and when the consumed amount V of ink reaches a predetermined amount, a desired amount of ink is supplied from the ink cartridge (main tank) 10 to the head tank 15 by the liquid supply mechanism without introducing the ambient air into the head tank 15 as described above. Note that the desired amount of ink to be supplied may be controlled by driving time (duration) of a pump. Note also that it is preferable that the desired amount of ink to be supplied equal the consumed amount V of ink; however, in reality, there may be some errors due to the variability in the amount of ink per ink droplet or the suctioned amount of ink in the computation of the consumed amount V of ink. Further, when ink is supplied by a pulsating operation such as pumping, the amount of ink supplied may vary with the timing of pumping. Thus, when ink is repeatedly supplied and consumed, the actual contained amount of ink inside the head tank 15 may gradually change due to such errors, and as a result, the negative pressure value may also change. Thus, as described above, the position of the negative pressure lever 106 is stored when the initial negative pressure is generated by suctioning a predetermined amount of ink after the head tank 15 is supplied with the ambient air. As the ink inside the head tank 15 is consumed, the film member 102 is further contracted and the negative pressure lever 106 is moved (displaced) toward the head tank 15 side with the deformation (contraction) of the film member 102. In the ordinary ink supply operation, the supply of ink is stopped when the negative pressure lever position detecting sensor (not shown) detects that the position of the negative pressure lever 106 has returned to its original position. In this manner, the errors due to the above-described variability may be decreased, and the initial negative pressure may be maintained in the head tank 15 immediately after the ink is supplied to the head tank 15.

As described above, the air introducing ink supply operation, in which ink is supplied to the head tank 15 by introducing the ambient air into the head tank 15, may not be carried out every time the ink in the head tank 15 is consumed. Thus, the air introducing ink supply operation may preferably be carried out only when the consumed amount of ink in the head tank 15 reaches a predetermined amount or more, and otherwise (i.e., when the consumed amount of ink in the head tank 15 does not reach the predetermined amount or more), the ordinary ink supply operation, in which the ink is supplied to the head tank 15 without introducing the ambient air into the head tank 15, may be carried out.

Figure 6:
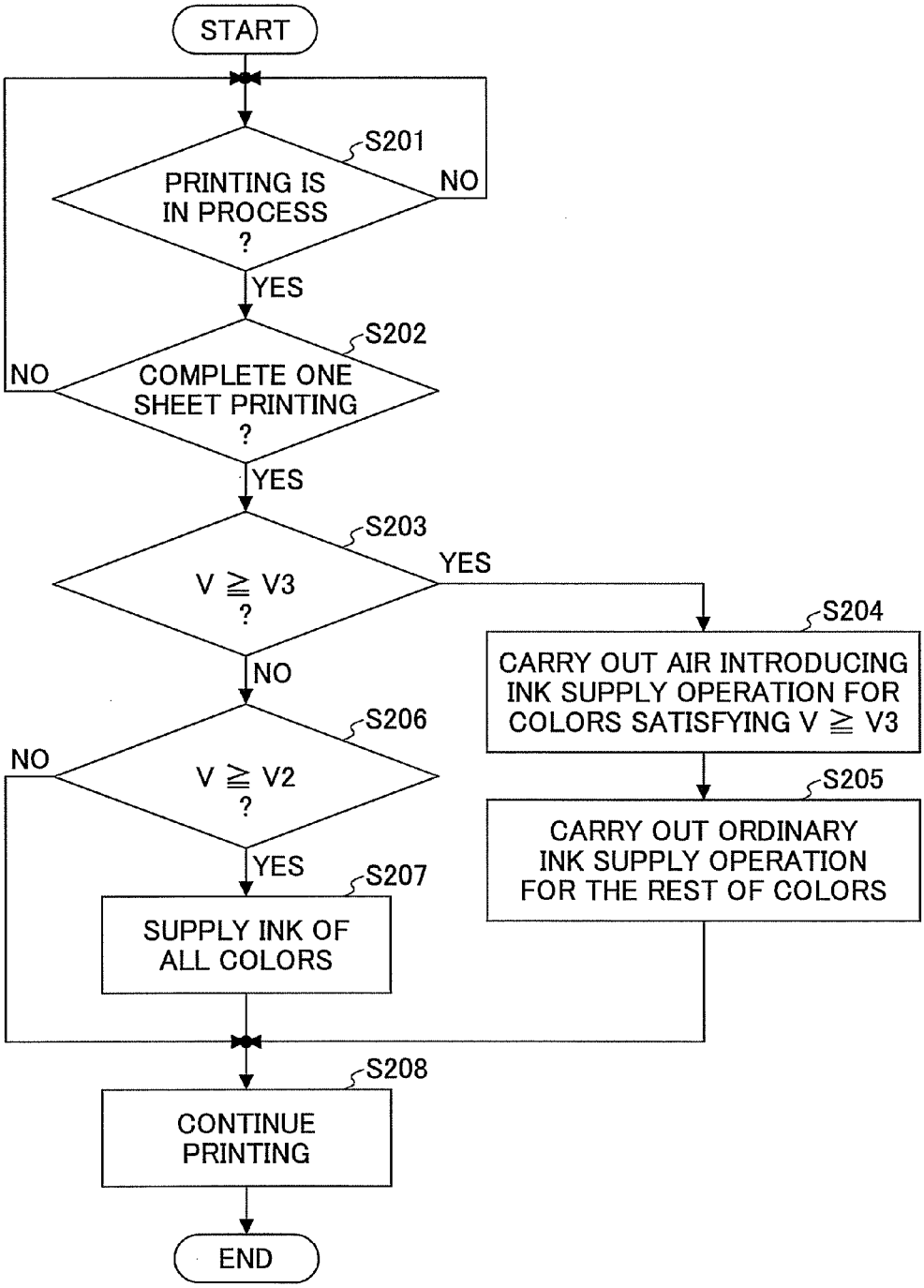
FIG. 6 is a flowchart illustrating an ink supply control operation by supplying ink in an ordinary manner.

Next, an ink supply control method is described in detail with reference to an operational flowchart illustrated in FIG. 6. As illustrated in FIG. 6, if printing is in process (Yes in step S201) and one sheet printing is completed (Yes in step S202), the consumed amount V of ink of each color detected in the above-described manner is detected, and whether the consumed amount V of ink in the head tank 15 is equal to or more than a first threshold V3 is determined (step S203). Note that the first threshold V3 is a predetermined amount of consumable ink. Note also that "one sheet printing" indicates one page printing, and also a one-side printing in duplex printing. If the determined result indicates that the consumed amount V is equal to or more than the first threshold V3 for one or more colors of ink in the corresponding head tank 15 (Yes in step S203), ink of corresponding colors (V≥V3) is supplied from the corresponding ink cartridge (main tank) 10 to the corresponding head tank 15 by the air introducing ink supply operation (step S204). The ink of the rest of colors that do not satisfy the condition V≥V3 is supplied to a corresponding head tank 15 by carrying out the ordinary ink supply operation (step S205), and the printing process is then continued (step S208). Meanwhile, if the determined result indicates that the condition V≥V3 is not satisfied for all the colors of ink (No in step S203), whether the consumed amount V of ink in the head tank 15 is equal to or more than a second threshold V2 (<V3) is determined (step S206). If there are some colors of ink satisfying the condition V≥V2 (Yes in step S206), the ordinary ink supply operation is carried out to supply all the colors of ink to the corresponding head tanks 15 (step S207), and the printing process is then continued (step S208).

Specifically, the ink supply device of the inkjet recording apparatus includes a counter to count (detect) the consumed amount V [ml] of ink. In the counter, the first threshold V1 is set at 0.2, the second threshold V2 is set at 0.9, and the third threshold V3 is set at 1.1. If the consumed amount V detected after a predetermined time has elapsed is equal to or more than the first threshold of 0.2, the ink of corresponding colors (V1≤V) is supplied by the ordinary ink supply operation. If the consumed amount V detected after completing one sheet printing is less than the third threshold of 1.1 and equal to or more than the second threshold of 0.9 (0.9≤V<1.1), the ink of all the colors is supplied by the ordinary ink supply operation, and the printing is then continued. If the consumed amount V is equal to or more than the third threshold of 1.1, the ink of corresponding colors satisfying V≥1.1 is supplied by the air introducing ink supply operation while ink of the rest of colors is supplied by the ordinary ink supply operation, and the printing is then continued.

Note that the embodiments are described by the examples in which the embodiments are applied to the inkjet recording apparatus; however, the embodiments may also be applied to printers, facsimile machines, copiers, or multifunctional peripherals having functions of a printer, a facsimile machine, and copier. Further, the embodiments may be applied to image forming apparatuses that utilize liquid other than ink and also to a liquid supply device of such image forming apparatuses.

Figure 7:
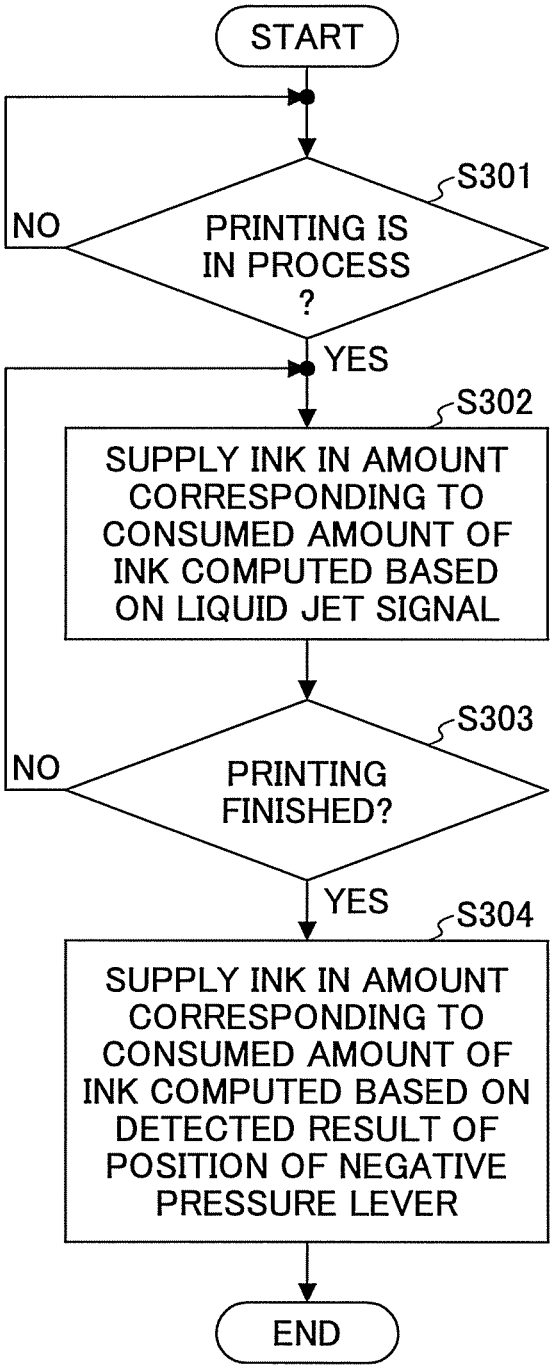
FIG. 7 is a flowchart illustrating an ink supply control operation by supplying ink to a head tank of the inkjet recording apparatus according to the embodiment.
Figure 8:
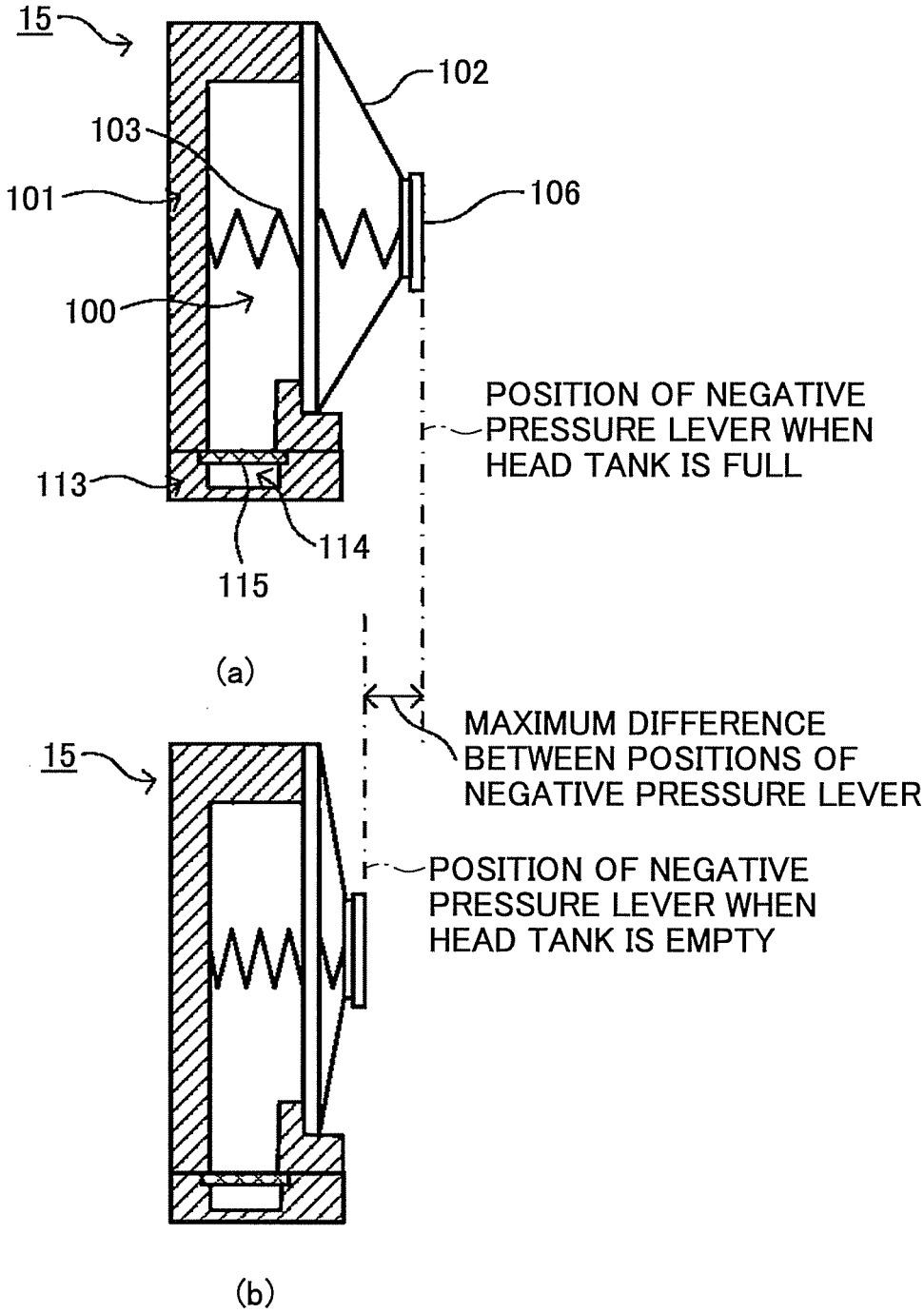
FIG. 8 is a schematic diagram illustrating profiles of a head tank ink amount detected based on positions of a negative pressure lever.
Figure 9:
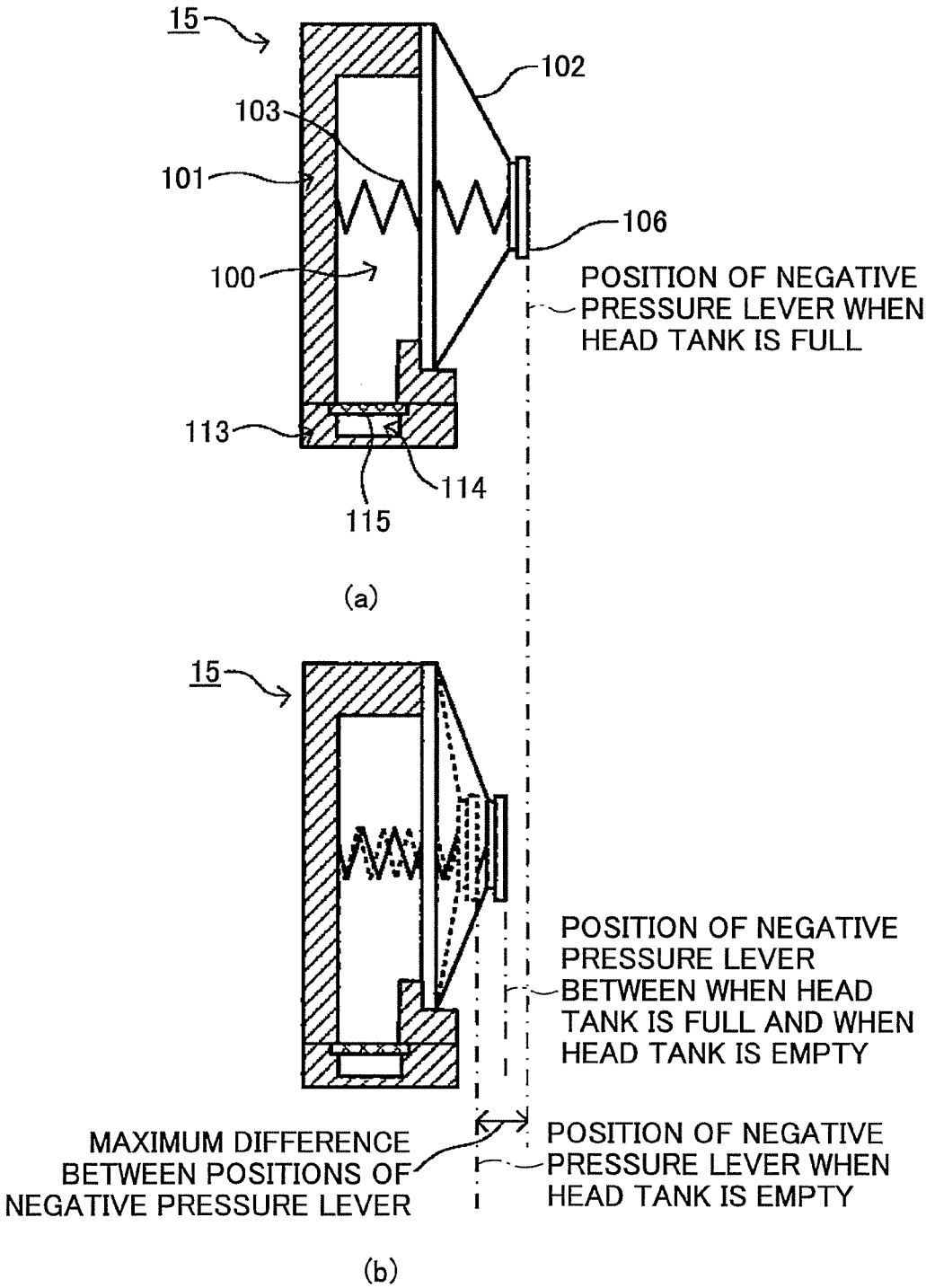
FIG. 9 is a schematic diagram illustrating profiles of the head tank when ink is supplied to the head tank based on a liquid-jet signal while printing.

FIG. 7 is a flowchart illustrating an ink supply control operation by supplying ink to the head tank 15 of the inkjet recording apparatus according to the embodiment. FIG. 8 is a schematic diagram illustrating profiles of the head tank 15 detected based on positions of the negative pressure lever 106. FIG. 9 is a schematic diagram illustrating profiles of the head tank 15 when ink is supplied to the head tank 15 based on a liquid-jet signal while printing.

In FIG. 7, the head tank 15 is already filled with ink based on the detected result of the position of the negative pressure lever 106. The ink is gradually consumed (decreased) while the printing is carried out by jetting ink from the nozzles (Yes in step S301). In this step, a liquid-jet signal for forming an image is supplied to a print head, and an ink jetted amount consumed based on the liquid-jet signal is computed based on a predetermined formula for computation. Ink is supplied to the head tank 15 in an amount corresponding to the computed consumed amount of ink based on the liquid-jet signal (step S302). The ink supply operation in step S302 is carried out while the printing is in process (No in step S303). When the printing is finished (Yes in step S303), the carriage is moved, the position of the negative pressure lever is detected, and ink is supplied based on the detected result of the position of the negative pressure lever (step S304). As illustrated in FIG. 8, the detection of the position of the negative pressure lever 106 is initiated when the head tank 15 is in a state illustrated in (a) part of FIG. 8, that is, the head tank 15 filled with ink to start printing. When the head tank is in a state illustrated in (b) part of FIG. 8 where the head tank 15 has a predetermined amount of ink (i.e., approximately none), the film member 102 of the head tank 15 is moved to a position at which the position of the negative pressure lever 106 is detected (read). Thereafter, ink is supplied until the head tank 15 is full as illustrated in (a) part of FIG. 8 while the position of the negative pressure lever 106 is being detected. Meanwhile, referring back to the ink supply operation in step S302 of FIG. 7, since a small amount of ink is gradually supplied to the head tank 15 while the printing is in process, the printing is not interrupted or stopped while supplying ink, thereby reducing printing time as illustrated in (b) part of FIG. 8.

However, as illustrated above, since the consumed amount of ink is calculated (counted) by software and the amount of ink actually supplied may differ based on a driving condition of an ink supply pump by which ink is supplied, the consumed amount of ink calculated by software and the amount of ink actually supplied by driving the ink supply pump may not be the same. Thus, the amount of ink actually contained in the head tank 15 may gradually change while ink is repeatedly consumed from and supplied to the head tank 15. If the actual contained amount of ink exceeds the amount of ink illustrated in (a) part of FIG. 9 where the head tank 15 is filled with ink, the negative pressure in a head section is reduced, which may cause instability of an inkjet operation or may, in the worst case, cause abrupt ink leakage from the nozzles. Further, if the actual contained amount of ink is less than the amount of ink illustrated in (b) part of FIG. 9 where the head tank 15 appears empty, the negative pressure in the head section is abnormally raised, which may also cause instability of the inkjet operation or may cause inkjet malfunction due to the suctioning of air through the nozzles. Accordingly, in the present embodiments, a liquid (ink) supply condition for supplying ink to the head tank 15 based on a liquid-jet signal cumulative value is determined in the following manner. First, liquid-jet signal cumulative values and amounts of ink actually jetted are calculated in advance, and then the upper limit of the actual jetted amount of ink corresponding to the liquid-jet signal cumulative value is determined. Further, a relationship between the amount of ink actually supplied by driving the liquid supply pump and the driving time of the liquid supply pump is obtained, and the determined upper limit of the actual jetted amount of ink corresponding to the liquid-jet signal cumulative value is set as a target value of the liquid supply amount corresponding to the driving time of the liquid supply pump. An actual liquid supply time is determined based on a lower limit of the liquid supply amount.

Figure 10:
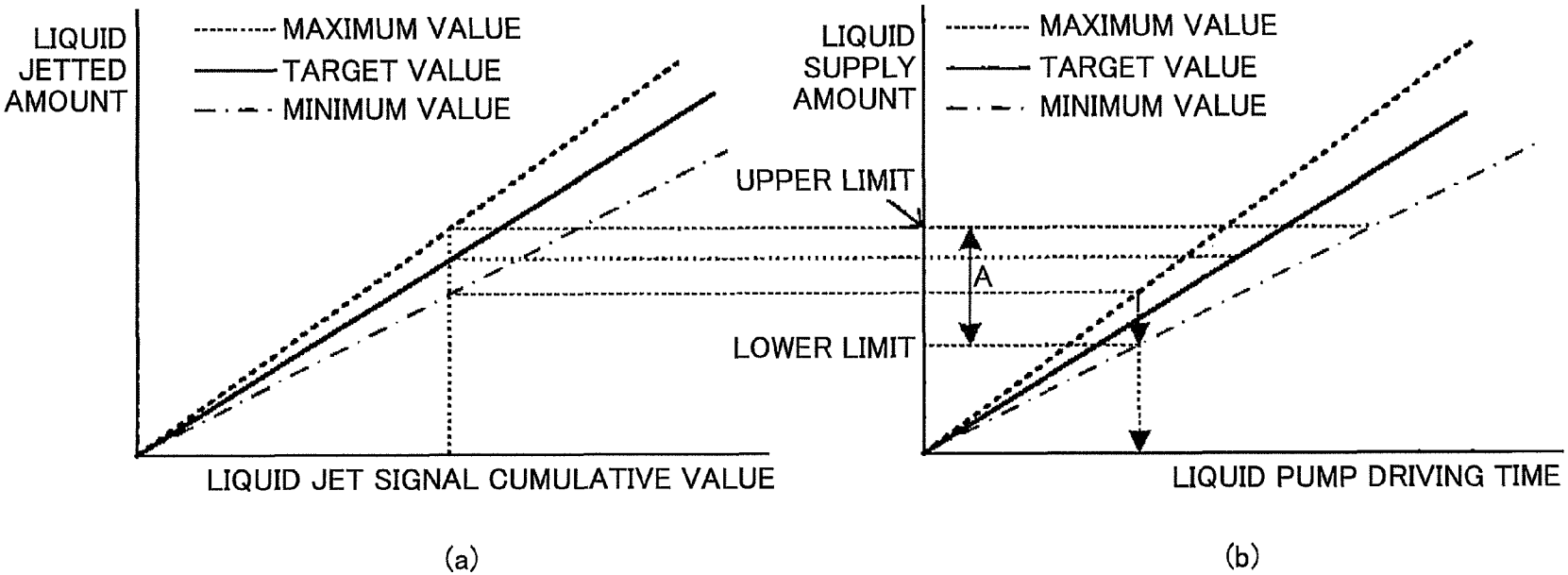
FIG. 10 includes diagrams illustrating an ink supply condition determined based on the liquid-jet signal according to the embodiment.

FIG. 10 includes diagrams illustrating an ink supply condition based on the liquid-jet signal according to the embodiment. The (a) part of FIG. 10 is a correlation diagram experimentally obtained between the amount of ink actually jetted from an inkjet head and an estimated amount of consumed ink obtained based on the liquid-jet signal cumulative value (counted by software). Note that the amount of ink jetted from the inkjet head may differ due to the variability in ink jet signals and the variability of inkjet heads. Thus, if maximum values (indicated by a dotted line in (a) part of FIG. 10) and minimum values (indicated by a dashed dotted line in (a) part of FIG. 10) are statistically determined, actual contained amounts of ink jetted from the inkjet head fall between the determined maximum values and minimum values, for almost all the inkjet heads. The (b) part of FIG. 10 is a correlation diagram experimentally obtained between an amount of ink actually supplied to the head tank and the driving time of the liquid supply pump used for supplying ink to the head tank. Note that the amount of ink supplied to the head tank may differ due to the variability of liquid supply pumps. Thus, if maximum values (indicated by a dotted line in (b) part of FIG. 10) and minimum values (indicated by a dashed dotted line in (b) part of FIG. 10) are statistically determined, actual contained amounts of ink supplied to the head tank fall between the maximum values and minimum values for almost all the liquid supply pumps. Note also that the driving time of the liquid supply pump may be any parameter insofar as the parameter specifies an ink supply condition based on which a certain amount of ink is supplied by the liquid supply pump such as a rotational angle.

The ink supply condition is determined as follows. Specifically, the ink supply condition is set such that the amount of ink actually jetted (i.e., a liquid-jetted amount indicated as a target value by a solid line in (a) part of FIG. 10) falls between the maximum value and the minimum value corresponding to the liquid-jet signal cumulative value illustrated in (a) part of FIG. 10. The driving time of the liquid supply pump is preferably determined based on the minimum value of the liquid-jetted amount corresponding to the liquid-jet signal cumulative value (i.e., a minimum liquid-jetted amount) indicated by a dashed-dotted line in (a) part of FIG. 10. However, in order to supply ink to the head tank in an amount to exceed the minimum ink jetted amount, the driving time of the liquid supply pump may preferably be set corresponding to the maximum value of the liquid supply amount indicated by the dotted line in (b) part of FIG. 10. If the driving time of the liquid supply pump is set in this manner, the amount of ink actually supplied to the head tank may be controlled to be less than the amount of ink actually consumed. Accordingly, even if the printing and ink supply operations are repeatedly carried out, the amount of ink contained in the head tank may not exceed the capacity of the head tank (i.e., a full-tank condition) (see FIG. 9). With this setting, the negative pressure in the head section is lower than a predetermined negative pressure. That is, the negative pressure in the head section may not become a positive pressure, and hence, image degradation due to ink leakage from the nozzles may be suppressed. In this case, the amount of ink actually supplied is reliably less than the amount of ink actually consumed, and the difference between the amount of ink actually supplied and the amount of ink actually consumed falls within a range indicated by an up-down arrow A in (b) part of FIG. 10. If the difference between the amount of ink actually supplied and the amount of ink actually consumed is too large, the amount of ink actually contained in the head tank is reduced, which may cause inkjet instability or inkjet malfunction due to air suctioned through the nozzles. In order to avoid the inkjet instability or inkjet malfunction, the difference between the maximum liquid-jetted amount estimated based on the liquid-jet signal and the minimum liquid supply amount by the liquid supply pump driven when the liquid is supplied based on the liquid-jet signal falls within a control range of the liquid amount in the head tank. Accordingly, the liquid is supplied within a liquid amount control range of the head tank, based on the detected result of the position of the negative pressure lever.

Figure 11:
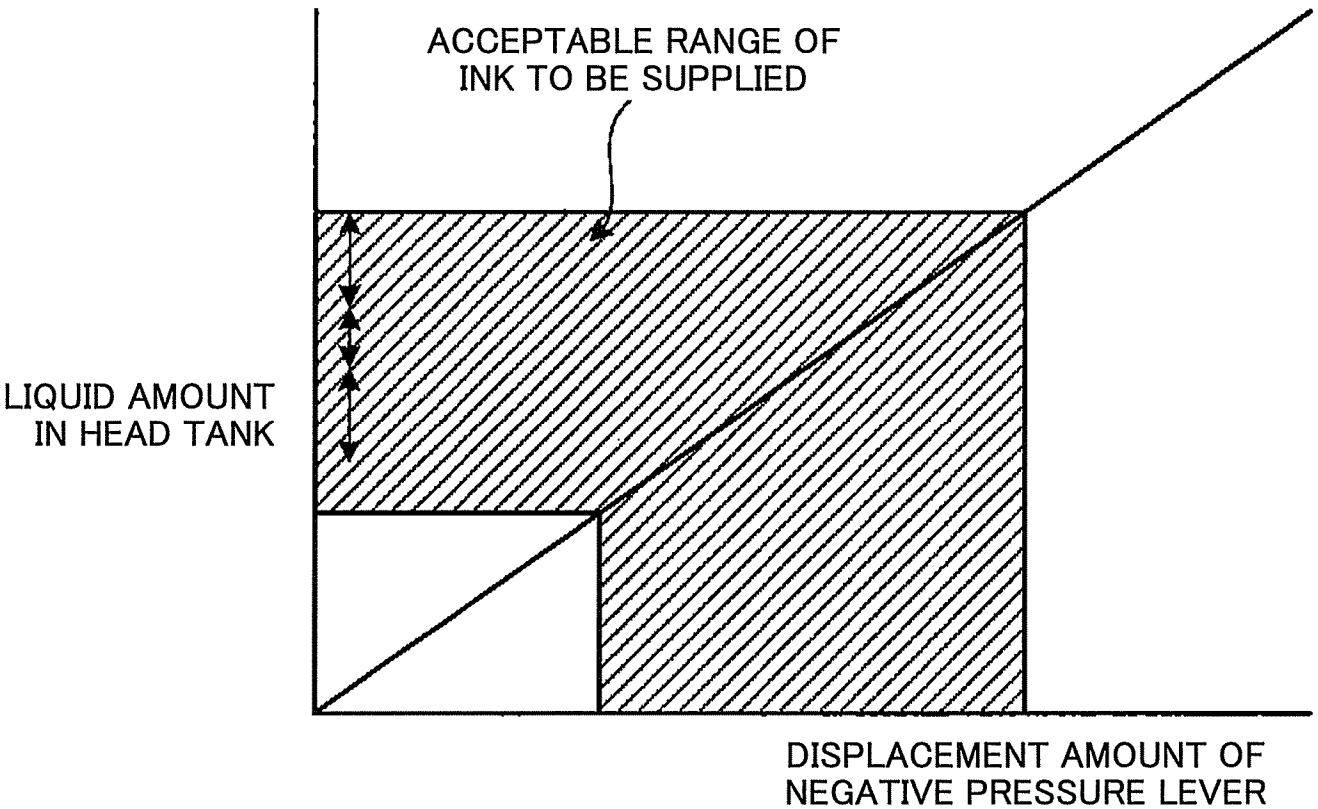
FIG. 11 is a diagram illustrating a correlation between a displacement amount of a negative pressure lever and a liquid amount in the head tank.

FIG. 11 is a diagram illustrating a correlation between a displacement amount of the negative pressure lever and the liquid amount in the head tank. Specifically, in the head tank of the related art inkjet recording apparatus illustrated in FIG. 7, the liquid amount in the head tank is controlled such that the liquid amount in the head tank falls within an appropriate range. Accordingly, in the head tank of the related art inkjet recording apparatus, the position of the negative pressure lever is detected by a sensor, and ink is supplied until the lever is displaced to a predetermined position. That is, the liquid amount in the head tank is controlled such that the liquid amount in the head tank falls within a range indicated by a hatched area in FIG. 11. In contrast, in the printing and ink supply operation carried out during printing according to this embodiment, a cumulative amount of liquid in the head tank for printing jobs indicated by up and down arrows in FIG. 11 may not be sufficient. Thus, ink is appropriately supplied to the head tank based on the detected position of the negative pressure lever at the right time to cancel out the difference between the amount of ink actually supplied and the amount of ink actually consumed, such that the cumulative amount of liquid in the head tank does not exceed the appropriate range of the liquid amount in the head tank. In this manner, the amount of ink actually contained in the head tank is reduced, thereby preventing the inkjet instability or inkjet malfunction due to air suctioned through the nozzles.

Note that it is not preferable that the frequency of ink supplied to the head tank during printing be unnecessarily high. For example, for the same amount of ink supplied to the head tank, an error in the amount of ink supplied may be smaller when the ink is supplied at once than when the ink is supplied in several increments. Further, the pressure in the head tank may change due to the ink supplied to the head tank, which may cause adverse effects on the inkjet operations.

Thus, it is preferable that the liquid supply based on the liquid-jet signal be carried out between the print jobs, between pages, or between scans in this order of priority. In addition, it is preferable that the liquid supply based on the liquid-jet signal be carried out while the liquid-jet operation is not being conducted. Accordingly, it is preferable to avoid supplying ink to the head tank while the inkjet operation is being conducted as the frequency of ink supplied to the head tank decreases.

Compared to the related art, the frequency of ink supplied based on the detected result of the position of the negative pressure lever may be decreased in this embodiment. However, it may be difficult to continue to decrease the frequency of ink supplied indefinitely. Accordingly, it may not be possible to cancel the ink supply based on the detected result of the position of the negative pressure lever except when the ink is all out. However, it may be possible to cancel the ink supply based on the detected result of the position of the negative pressure lever in the middle of printing operation.

As described above, in the inkjet recording apparatus according to the embodiment, the head tanks 15 fixed on the carriage 13 (see FIGS. 1 and 2) having the recording heads 14 each include the flexible film member 102 forming one surface of the head tank 15, and the elastic member 103 applying bias to the film member 102 in the direction from inside to outside of the film member 102 when a negative pressure is generated in the head tank 15 as illustrated in FIG. 4. In the film member 102 forming the head tank 15, when ink is supplied to the head tank 15 after the ambient air is introduced to the head tank 15, the film member 102 expands as the volume of ink is increased, and the film member 102 contracts as the volume of ink is decreased when ink is jetted from the head tank 15 after the air introduction is cancelled. The film member 102 includes the function to generate a negative pressure in a liquid container after the air introduction is cancelled. Further, the head tanks 15 includes the negative pressure lever 106 arranged in contact with the outer surface of the film member 102 to displace its position based on the deformation of the film member 102 caused by the expansion and the contract of the film member 102. When the head tank 15 is filled with ink, the air introduction to the head tank 15 is cancelled, and the positional information on the negative pressure lever 106 is stored when the initial negative pressure is generated in the head tank by discharging several ink droplets from the head tank 15. With this configuration, the deformed amount of the film member 102 may be detected by detecting the position of the negative pressure lever 106. That is, the amount of ink increased or decreased may be detected by detecting the position of the negative pressure lever 106. The position of the negative pressure lever 106 is detected when ink needs to be supplied or after the printing is completed, and ink is supplied to the head tank 15 until the position of the negative pressure lever 106 reaches the position initially stored (recorded) when the head tank 15 has been at the initial negative pressure. As a result, ink may be supplied to the head tank 15 such that the head tank 15 is filled with ink. When printing is initiated, ink is supplied based on the detected result of the position of the negative pressure lever. Then, the consumed amount of ink corresponding to the amount of ink jetted from the head tank is computed based on the liquid-jet signal for forming an image. Ink is supplied to the head tank in an amount corresponding to the computed result of the consumed amount of ink. The head tank may not run out of ink while printing is in process, and little time may be consumed for the carriage traveling when the position of the negative pressure lever is detected. Thus, the printing time may be reduced.

Further, as illustrated in FIG. 10, a lower limit (i.e., lower threshold) of a distribution of the actual ink jetted amount corresponding to the estimated ink jetted amount computed based on the liquid-jet signal is obtained. Moreover, an upper limit (i.e., an upper threshold) of a distribution of the actual liquid supply amount corresponding to an estimated ink supply amount computed based on the liquid supply driving signal supplied to the supply pump and also corresponding to the lower limit of the distribution of the actual ink jetted amount corresponding to the estimated ink jetted amount computed based on the liquid-jet signal is computed and stored. When the meniscus pressure of the recording head detected based on the detected position of the negative pressure lever is lower than the lower limit of an appropriate pressure range, ink is supplied to the head tank until the meniscus pressure of the recording head reaches (i.e., until the meniscus pressure of the recording head is restored to) the upper limit of the appropriate pressure range.

Further, the ink supply amount in an ink supply operation based on the liquid-jet signal is computed based on the lower limit of the distribution of the ink jetted amount, and the computed ink supply amount is further computed based on the upper limit of the distribution of the ink supply amount. Further, as illustrated in FIG. 11, in the related art, the liquid is supplied to the head tank in an amount less than the liquid-jetted amount computed based on the liquid-jet signal. Thus, when the actual contained amount of ink is less than the amount of ink when the head tank 15 is empty illustrated in (b) of FIG. 9, the negative pressure in the recording head is abnormally raised, which may also cause instability of the inkjet operation or may cause inkjet malfunction due to the suctioning of air through the nozzles.

Further, in embodiments of the present invention, the ink supply operation may be performed between printing jobs, between printing pages, or between scans in this order of priority. The ink supply operation based on the liquid-jet signal is being carried out when ink is not jetted from the recording head. As described above, if ink is supplied when the printing is temporarily not carried out, that is, if ink is supplied when an image forming operation is not being carried out, the printing time may be reduced.

The embodiments of the invention described so far are not limited thereto. Various modifications alterations may be made within the scope of the inventions described in the claims.

According to embodiments, the number of times the printing is temporarily stopped for supplying ink may be reduced, and hence the printing time may also be reduced accordingly.

Further, the present invention is not limited to these embodiments, but various variations and modifications may be made without departing from the scope of the present invention.

The present application is based on Japanese Priority Application No. 2010-059765 filed on Mar. 16, 2010, with the Japanese Patent Office, the entire contents of which are hereby incorporated by reference.

What is claimed is:

1. A method for supplying a liquid from a liquid tank to a head tank fixed to a liquid-jet head utilizing a liquid supply device in a liquid-jet apparatus, the method comprising:

(a) jetting liquid droplets from the liquid-jet head while maintaining a meniscus pressure of the liquid-jet head within a predetermined range;

(b) detecting the meniscus pressure of the liquid-jet head;

(c) carrying out, when the detected meniscus pressure is lower than the predetermined range, a first liquid supply operation such that the detected meniscus pressure of the liquid-jet head being lower than the predetermined range is restored to the predetermined range, the first liquid supply operation including (c1) supplying a predetermined amount of ink from the liquid tank to the head tank while (c2) a detector detects a supply amount; and (d) carrying out, while the first liquid supply operation is not being carried out, a second liquid supply operation such that the liquid is supplied to the head tank in an amount less than a liquid-jetted amount computed based on a liquid-jet signal, the second liquid supply operation including (d1) supplying a predetermined amount of ink from the liquid tank to the head tank (d2) without detecting the supply amount in the second liquid supply operation.

2. The method as claimed in claim 1, wherein a liquid supply amount of the liquid supplied to the head tank by the second ink supply operation is computed based on a liquid-jet threshold of a distribution of an actual liquid-jetted amount corresponding to the liquid-jetted amount computed based on the liquid-jet signal.

3. The method as claimed in claim 2, wherein a liquid supply driving signal supplied to the liquid supply device is determined based on the liquid-jet threshold of the distribution of the actual liquid-jetted amount corresponding to the liquid-jetted amount computed based on the liquid-jet signal, and based on a liquid supply threshold of a distribution of an actual liquid supply amount corresponding to a liquid supply amount computed based on the liquid supply driving signal, and the liquid is supplied from the liquid tank to the head tank by driving the liquid supply device based on the determined liquid supply driving signal.

4. The method as claimed in claim 3, wherein the liquid supply threshold is an upper limit of the distribution of the actual liquid supply amount corresponding to the liquid supply amount computed based on the liquid supply driving signal.

5. The method as claimed in claim 2, wherein the liquid-jet threshold is an upper limit of the distribution of the actual liquid-jetted amount corresponding to the liquid-jetted amount computed based on the liquid-jet signal.

6. The method as claimed in claim 1, wherein the first liquid supply operation is carried out for supplying a liquid in a liquid supply amount such that a cumulative value of the liquid supply amount of the liquid supplied to the head tank by the second ink supply operation does not exceed the liquid supply amount supplied by the first liquid supply operation.

7. The method as claimed in claim 1, wherein the second liquid supply operation is carried out between printing jobs, between printing pages, or between scans in this order of priority.

8. The method as claimed in claim 1, wherein the second liquid supply operation is carried out while the liquid-jet head is not jetting liquid droplets.

9. The method as claimed in claim 1, wherein the jetting of the liquid droplets by the liquid-jet head in (a) is controlled based on a liquid-jet signal, and the amount of ink to be supplied in (d1) in the second liquid supply operation is computed based on the liquid-jet signal

10. The method as claimed in claim 1, wherein the second liquid supply operation from the liquid tank to the head tank in the amount computed based on the liquid-jet signal is performed while droplet ejection from the liquid-jet head is performed.

11. The method as claimed in claim 1, wherein the amount of ink to be supplied in (c1) in the second liquid supply operation is computed based on the supply amount detected by the detector.

12. The method as claimed in claim 1, wherein the first liquid supply operation from the liquid tank to the head tank in the amount computed based on the supply amount detected by the detector is performed while droplet ejection from the liquid-jet head is not being performed.

13. A liquid-jet apparatus, comprising:

a liquid-jet head configured to receive a liquid-jet signal and eject liquid droplets based on the liquid-jet signal;

a head tank coupled to the liquid-jet head;

a liquid tank configured to store a liquid to be supplied to the head tank, the head tank in turn storing the liquid and selectively supplying the liquid to the liquid-jet head;

a pressure detection unit configured to detect a pressure in the head tank;

a supply amount detector configured to detect a supply amount of the liquid supplied from the liquid tank to the head tank;

an ink supply unit configured to control supply of the liquid from the liquid tank to the head tank, in a first liquid supply operation and in a second liquid supply operation, in accordance with the liquid-jet signal, wherein the ink supply unit monitors a meniscus pressure of the liquid-jet head, based on the pressure detected by the pressure detection unit, and controls supply of the liquid from the liquid tank to the head tank to maintain a meniscus pressure of the liquid-jet head within a predetermined range, while the liquid droplets are jetted from the liquid-jet head, carry out, when the detected meniscus pressure is lower than the predetermined range, the first liquid supply operation such that the detected meniscus pressure of the liquid-jet head being lower than the predetermined range is restored to the predetermined range, the first liquid supply operation including (c1) supplying a predetermined amount of ink from the liquid tank to the head tank while the detector detects the supply amount, and carry out, while the first liquid supply operation is not being carried out, the second liquid supply operation such that the liquid is supplied to the head tank in an amount less than a liquid-jetted amount computed based on the liquid-jet signal, the second liquid supply operation including (d1) supplying a predetermined amount of ink from the liquid tank to the head tank (d2) without detecting the supply amount in the second liquid supply operation.

* * * * *